US008770299B2

(12) United States Patent
King

(10) Patent No.: US 8,770,299 B2
(45) Date of Patent: Jul. 8, 2014

(54) TUBULAR ACTUATING SYSTEM AND METHOD

(75) Inventor: James G. King, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 458 days.

(21) Appl. No.: 13/089,646

(22) Filed: Apr. 19, 2011

(65) Prior Publication Data

US 2012/0266994 A1 Oct. 25, 2012

(51) Int. Cl.
*F16L 55/11* (2006.01)

(52) U.S. Cl.
USPC ..... 166/373; 166/318; 166/194; 166/386; 138/89

(58) Field of Classification Search
USPC ..... 138/89; 166/318, 152, 306, 188, 373, 166/194, 332.8, 386
See application file for complete search history.

(56) References Cited

U.S. PATENT DOCUMENTS

| | | | | |
|---|---|---|---|---|
| 6,006,838 | A | 12/1999 | Whiteley et al. | |
| 7,322,417 | B2 | 1/2008 | Rytlewski et al. | |
| 7,325,617 | B2 * | 2/2008 | Murray | 166/376 |
| 7,377,321 | B2 | 5/2008 | Rytlewski | |
| 7,387,165 | B2 | 6/2008 | Lopez de Cardenas et al. | |
| 7,503,392 | B2 * | 3/2009 | King et al. | 166/373 |
| 7,628,210 | B2 | 12/2009 | Avant et al. | |
| 7,637,323 | B2 | 12/2009 | Schasteen et al. | |
| 7,644,772 | B2 | 1/2010 | Avant et al. | |
| 7,661,478 | B2 * | 2/2010 | Palmer et al. | 166/318 |
| 7,673,677 | B2 | 3/2010 | King et al. | |
| 7,832,472 | B2 * | 11/2010 | Themig | 166/191 |
| 7,861,774 | B2 | 1/2011 | Fehr et al. | |
| 7,954,555 | B2 * | 6/2011 | Ashy et al. | 166/386 |
| 2007/0272413 | A1 * | 11/2007 | Rytlewski et al. | 166/318 |
| 2008/0066924 | A1 * | 3/2008 | Xu | 166/376 |
| 2008/0093080 | A1 * | 4/2008 | Palmer et al. | 166/318 |
| 2009/0056952 | A1 * | 3/2009 | Churchill | 166/373 |
| 2009/0159289 | A1 * | 6/2009 | Avant et al. | 166/316 |
| 2009/0308588 | A1 * | 12/2009 | Howell et al. | 166/66.4 |
| 2011/0030968 | A1 | 2/2011 | Xu | |
| 2011/0108284 | A1 * | 5/2011 | Flores et al. | 166/373 |
| 2011/0180274 | A1 * | 7/2011 | Wang et al. | 166/386 |

OTHER PUBLICATIONS

Baker Hughes, Baker Oil Tools, Conventional Fishing Technical Unit; Pump Out Sub Product Family No. H14061, Jun. 7, 2005, 1 page.

(Continued)

*Primary Examiner* — Paul R Durand
*Assistant Examiner* — Donnell Long
(74) *Attorney, Agent, or Firm* — Cantor Colburn LLP

(57) ABSTRACT

A tubular actuating system includes a plurality of series of actuators disposed within a tubular with at least one of the series having a plurality of actuators. Each of the plurality of actuators in the at least one of the series is alterable from a first position allowing passage of plugs below a selected size to a second position allowing actuation by plugs of selected sizes. The plurality of actuators of the series are distributed within the tubular such that the more upstream of any two of the plurality of actuators is actuatingly engagable with a larger one of the plugs than the more downstream of the two of the plurality of actuators when in the second position, and the plurality of series is distributed such that for any two of the series the more upstream of the two series requires a larger plug to alter the actuators therewithin.

14 Claims, 4 Drawing Sheets

(56) References Cited

OTHER PUBLICATIONS

Boscan, J., et al., "Successful Well Testing Operations in High-Pressure/High-Temperature Encironment; Case Histories," SPE 84096, Oct. 2003, pp. 1-15.
Brad Musgrove, Multi-Layer Fracturing Solution Treat and Produce Completions, Nov. 12, 2007, pp. 1-23, Schlumberger, U.S.A.
G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.
Hoffman, C.R., "One-Trip Sand-Control/Liner Hangar/ Big-Bore Completion System," SPE 101086, Sep. 2006, pp. 1-10.
RFID Keystone Module, RFID & Intelligent Products, Petrowell retrieved online on May 27, 2009 from: http://www.petrowell.co.uk/index2.php?option=com_docman&task=doc_view&gid=15&Itemid=26.
Ross, C. M., et al., "Current Materials and Devices for Control of Fluid Loss," SPE 54323, Apr. 1999, pp. 1-16.
StageFRAC Maximize Reservoir Drainage, 2007, pp. 1-2, Schlumberger, U.S.A.
TAP Completion System, Schlumberger, 4 pages, Dec. 2007.
Notification of Transmittal of the International Search Report and the Written Opinion of the International Searching Authority; PCT/US2012/034243; Mailed Nov. 1, 2012; 10 pages.

* cited by examiner

TUBULAR ACTUATING SYSTEM AND METHOD

BACKGROUND

Tubular system operators are always receptive to new methods and devices to permit actuation of tubular tools such as those in industries concerned with earth formation boreholes, such as hydrocarbon recovery and gas sequestration, for example. It is not uncommon for various operations in these industries to utilize a temporary or permanent plugging device against which to build pressure to cause an actuation.

Sometimes actuating is desirable at a first location, and subsequently at a second location. Moreover, additional actuating locations may also be desired and the actuation can be sequential for the locations or otherwise. Systems employing droppable members, such as balls, for example, are typically used for just such purpose. The ball is dropped to a ball seat positioned at the desired location within the borehole thereby creating the desired plug to facilitate the actuation.

In applications where the first location is further from surface than the second location, it is common to employ seats with sequentially smaller diameters at locations further from the surface. Dropping balls having sequentially larger diameters allows the ball seat furthest from surface to be plugged first (by a ball whose diameter is complementary to that seat), followed by the ball seat second furthest from surface (by a ball whose diameter is complementary to that seat) and so on.

The foregoing system, however, creates increasingly restrictive dimensions within the borehole that can negatively impact flow therethrough as well as limit the size of tools that can be run into the borehole. Systems and methods that allow operators to increase the number of actuatable locations within a borehole without the drawbacks mentioned would be well received in the art.

BRIEF DESCRIPTION

Disclosed herein is a tubular actuating system. The system includes a plurality of series of actuators disposed within a tubular with at least one of the series having a plurality of actuators. Each of the plurality of actuators in the at least one of the series is alterable from a first position allowing passage of plugs below a selected size to a second position allowing actuation by plugs of selected sizes. The plurality of actuators within the at least one of the series is distributed within the tubular such that the more upstream of any two of the plurality of actuators is actuatingly engagable with a larger one of the plugs than the more downstream of the two of the plurality of actuators when in the second position, and the plurality of series is distributed such that for any two of the series the more upstream of the two series requires a larger plug to alter the actuators therewithin.

Further disclosed is a method of actuating a plurality of tubular actuators which includes running at least one plug through a tubular and past a series of actuators without altering actuators in the series, running an additional plug and altering the actuators in the series, and running additional plugs with sequentially increasing dimensions and actuatingly engaging the actuators in the series.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Embodiments of tubular actuating systems disclosed herein include actuators disposed in a tubular that are altered during passage of a first plug run thereby such that the actuators are seatingly engagable with a second plug of the same or different dimensions run thereagainst. The actuators are divided into a plurality of series wherein each of the actuators within a given series is alterable by a ball of a specific size, with series more upstream being alterable by plugs having larger dimensions.

First a detailed description of one of the alterable actuators will be made with reference to the figures after which a description of the series of actuators that make up the tubular actuating system 10 will be provided.

Figure 1:
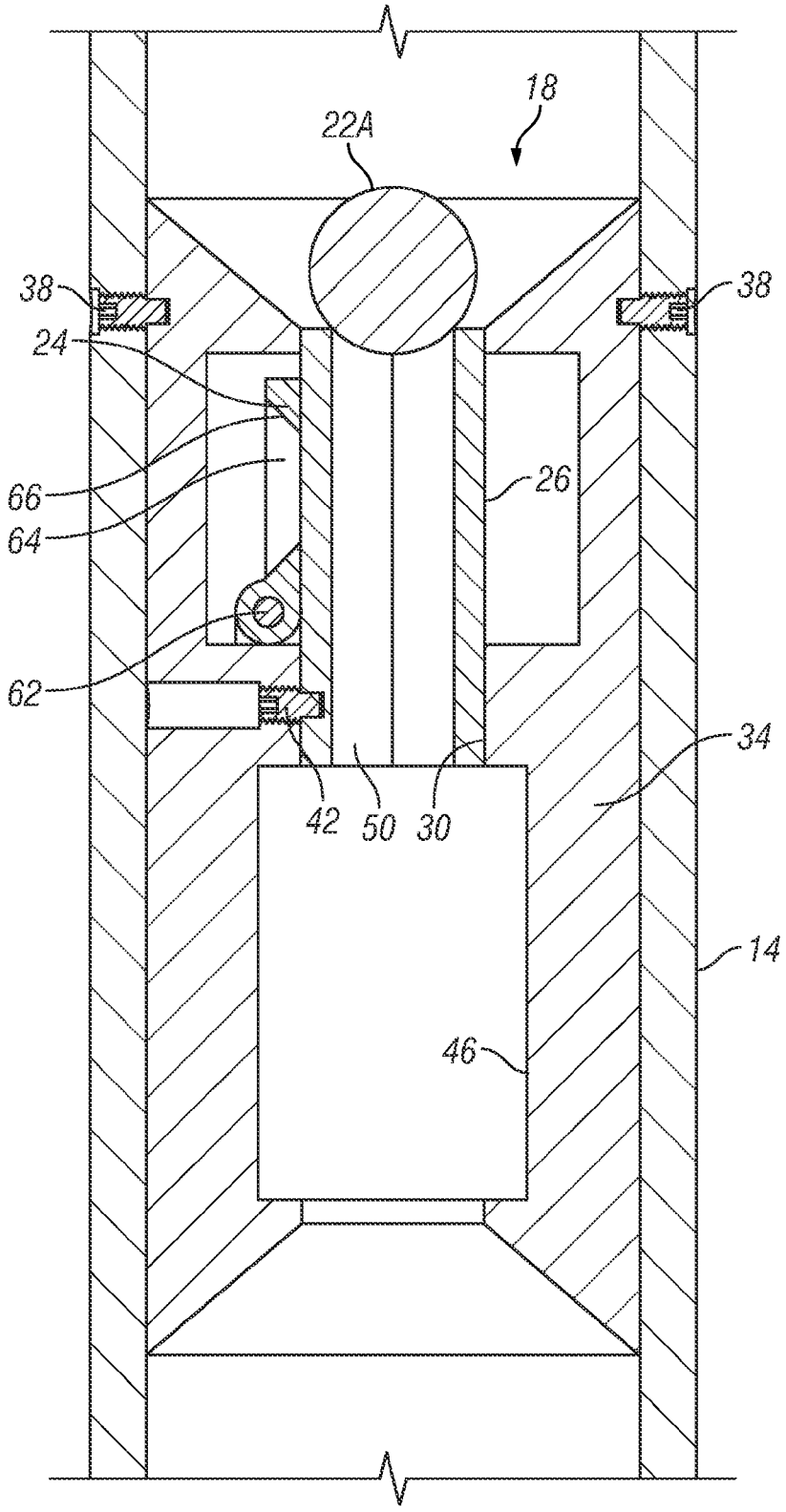
FIG. 1 depicts a cross sectional view of a tubular actuator employed in the tubular actuating system disclosed herein engaged with a first plug.
Figure 2:
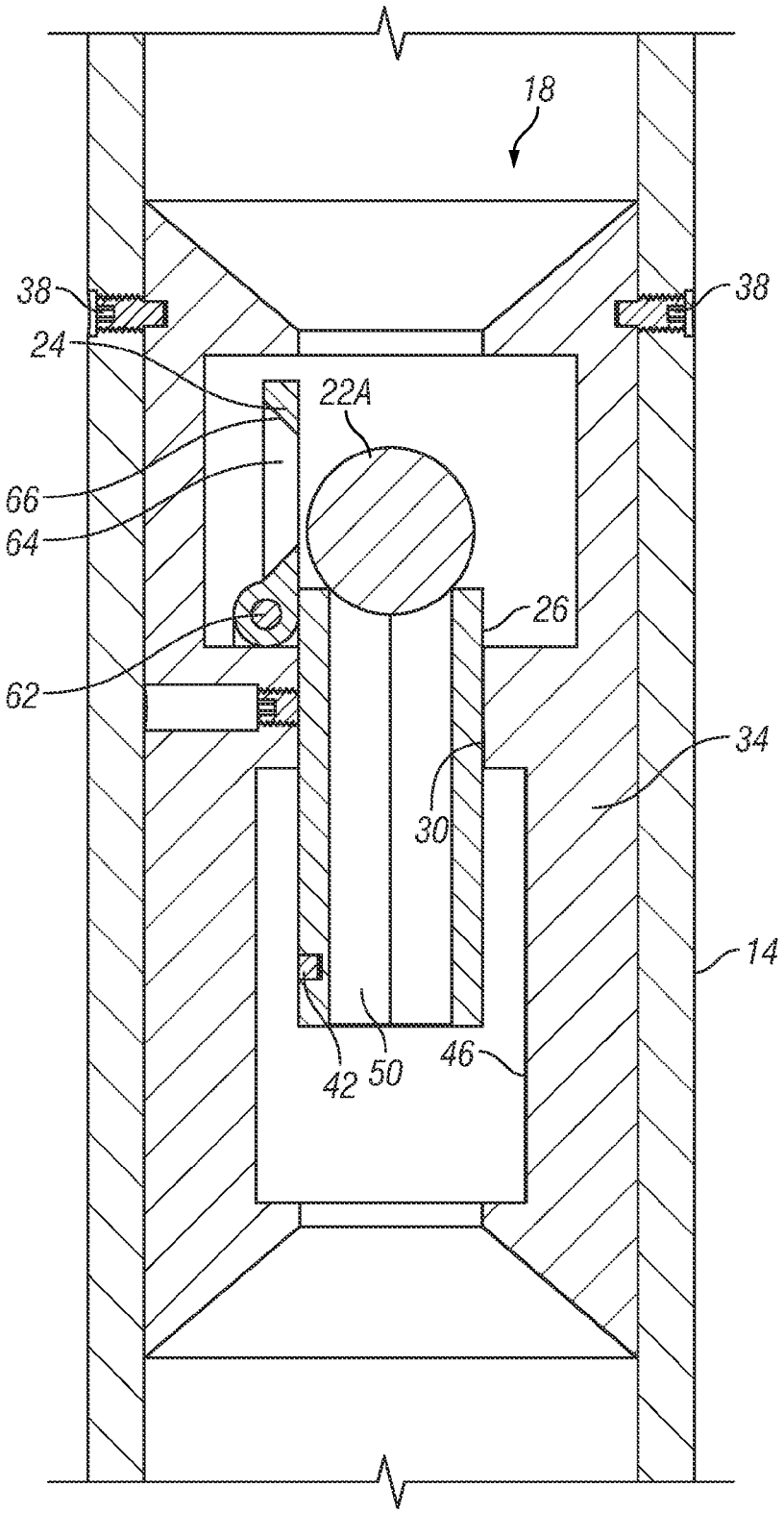
FIG. 2 depicts a cross sectional view of the tubular actuator of FIG. 1 engaged with the first plug after the first plug has moved a support member.
Figure 3:
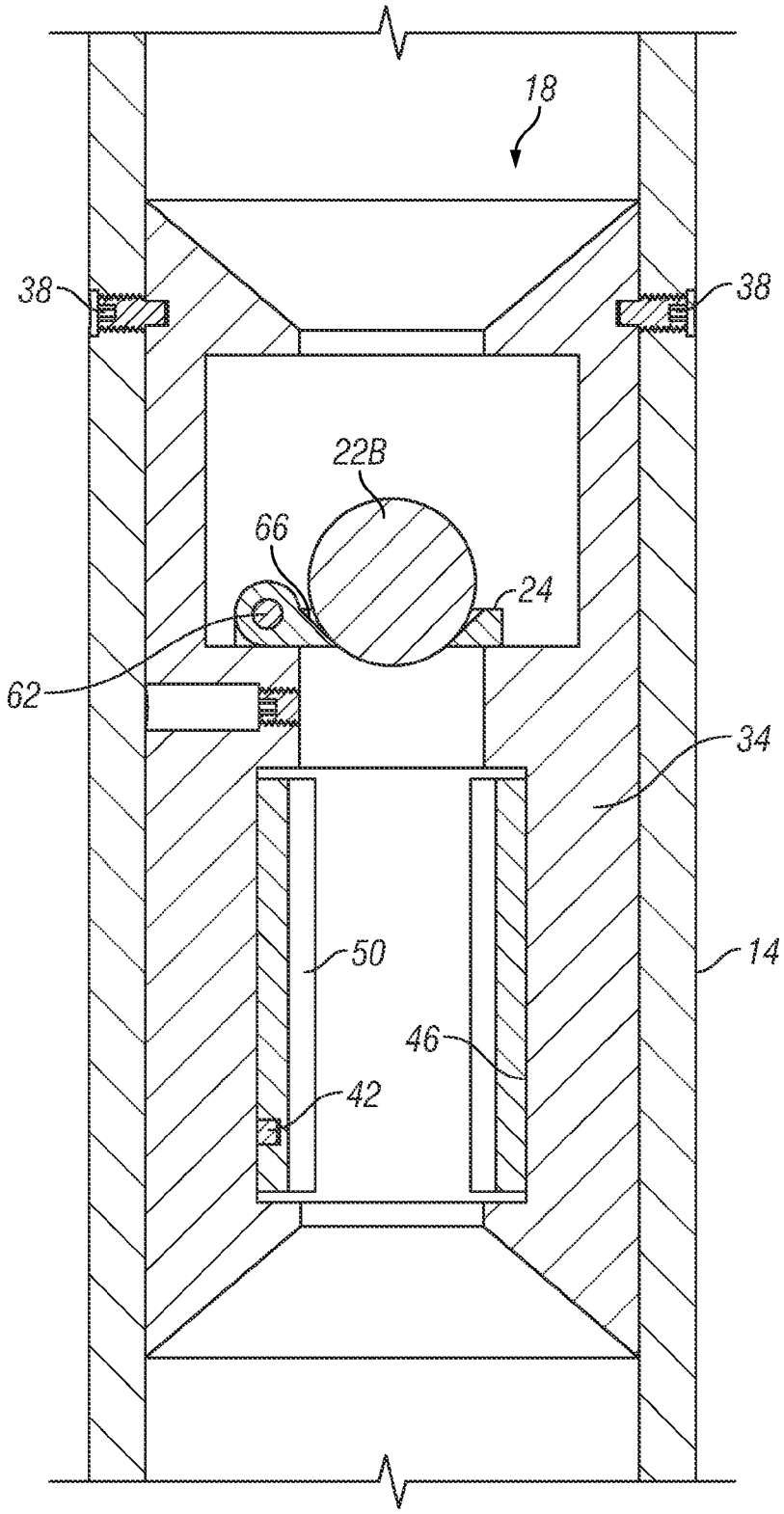
FIG. 3 depicts a cross sectional view of the tubular actuator of FIG. 1 in an altered position and engaged with a second plug after having passed the first plug.

Referring to FIGS. 1-3, an embodiment of an alterable actuator used in a tubular actuating system 10 (FIG. 4) disclosed herein is illustrated generally at 18. The alterable actuator 18 is housed within a tubular 14 that is alterable by a plug 22A runnable within the tubular 14. The plug 22A is illustrated herein as a ball. The actuator 18 is configured to be altered by the first ball 22A of a selected size runnable thereagainst. The alteration includes repositioning a flapper 24 from a first position (FIGS. 1 and 2) wherein it is not engagable by a ball to a second position (FIG. 3) wherein it is engagable by a ball.

Alteration of the alterable actuator 18 will now be explained. An expandable support member 26, illustrated herein as a C-ring, is restrained perimetrically by a small inner radial surface portion 30 of a sleeve 34 that is longitudinally fixed to the tubular 14 by one or more release members 38, shown as shear screws (FIG. 1). The C-ring 26 is fixed longitudinally to the sleeve 34 by one or more release members 42, also shown herein as a shear screw. The sleeve 34 has a large inner radial surface portion 46 that permits the C-ring 26 to expand radially outwardly when the C-ring 26 is moved longitudinally beyond the small inner radial surface portion 30 (FIG. 2). The C-ring 26 is urged to move longitudinally by pressure acting upon the ball 22A that is seated against the C-ring 26. The ball 22A is allowed to pass through a bore 50 of the C-ring 26 when the C-ring 26 is in the radially expanded position (FIG. 3).

The flapper 24, is biased from the first position (FIGS. 1 and 2) wherein the flapper 24 is oriented substantially parallel a longitudinal axis of the tubular 14 toward the second position (FIG. 3) wherein the flapper 24 is oriented substantially perpendicular to the longitudinal axis of the tubular 14 by a biasing member (not shown) such as a torsion spring, for example. At least one of the C-ring 26 and the first ball 22A prevent the flapper 24 from moving to the second position until the C-ring 26 and the ball 22A have passed sufficiently by the flapper 24 to allow the flapper 24 to rotate about a pivot point 62.

Once the flapper 24 is in the second position as illustrated in FIG. 3, a port 64 in the flapper 24 includes a seat 66 for ball 22B of a selected size while permitting fluid flow and pressure therethrough. As such, the ball 22A may seatingly engage another seat (not shown in this embodiment) positioned further along the tubular 14 than the actuator 18, and fluid flow through the port 64 can allow for additional operations therethrough, such as, actuations, fracturing and production, for example, in the case wherein the tubular is used in a downhole wellbore for hydrocarbon recovery.

When the second ball 22B is seatingly engaged in the port 64 of the flapper 24, pressure built up against the second ball 22B, the flapper 24 and the sleeve 34 can create longitudinal forces adequate to shear the shear screws 38. After the shear screws 38 have sheared the sleeve 34 of the actuator 18 can be urged to move relative to the tubular 14 to actuate a tool (not shown). This actuation can also be used to open ports (not shown) through the tubular 14 in a tubular valving application such as a fracing operation, for example.

Figure 4:
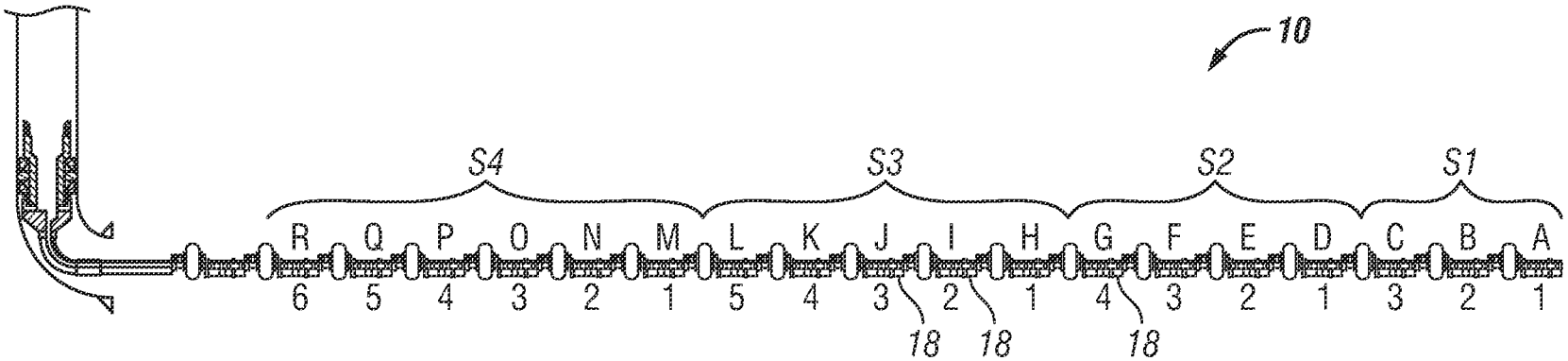
FIG. 4 depicts a schematic view of a tubular actuating system disclosed herein.

Referring to FIG. 4, a plurality of the alterable actuators 18 are illustrated in the tubular actuating system 10. For the sake of simplicity letters are used to designate each of the actuators 18 in the system 10, with A being the most downstream actuator and B the next most downstream actuator, etc. Sizes of the balls 22A and 22B are designated by sequential numbers with 1 being the smallest size and 2 the next smallest size, etc. It should be understood that the number of actuators, and the number of different size balls used in this embodiment are for explanatory purposes only and any practical number of actuators and different ball sizes can be employed. For example, sizes of balls in an actual system can vary in increments of one-eighth inch or smaller. In this embodiment four series of actuators are illustrated as S1-S4 with S1 being the most downstream and S2 being the second most downstream, etc.

Series S1 includes actuators A, B and C, series S2 includes actuators D, E, F and G, series S3 includes actuators H, I, J, K and L, and series S4 includes actuators M, N, O, P, Q and R. Since series S1 is the furthest downstream the actuators A, B and C need not be alterable, and can be actuated by balls directly. For example, a ball of size 1 can actuate actuator A, a ball of size 2 can actuate actuator B, and a ball of size 3 can actuate the actuator C. Note that balls of size 3 can pass through actuators D-R without either altering or actuating them.

The actuator D is the next uphole actuator to be actuated. The actuator D must be altered first before it is in a position to be actuatable. A ball of size 4 alters all four of the actuators D-G in the series S2. Once altered the actuators D-G can be actuated by whatever ball sizes desired by employing the flapper port 64 and seat 66 of a selected size. In this embodiment the actuators D-F are configured with seats engagable with balls of size 1-3 respectively. Actuator G is actuatable by a ball of size 4. As such, each series can include one additional actuator than the series immediately downstream thereof since the last actuator of a given series (i.e. the most upstream actuator) can be actuated by a ball size that was used to alter all of the actuators in that series. It should be noted that the actuators after being altered can be made to actuate with any ball sized desired, however, in this embodiment, since actuating balls need to pass through the series thereabove, it is beneficial to have the largest actuating ball for a series be able to pass through the series thereabove without altering it.

All five of the actuators, H-L, in series S3 are alterable by a ball of size 5 after which they can be actuated sequentially by balls increasing in size from 1-5. Similarly, the six actuators, M-R, in series S4 are alterable by a ball of size 6 after which they can be actuated sequentially by balls increasing in size from 1-6. The tubular actuating system 10 can therefore be made to have significantly more actuators 18 for a given number of different ball sizes than currently known systems.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment(s) disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A tubular actuating system, comprising:

a plurality of series of actuators disposed within a tubular with at least one of the series having a plurality of actuators, each of the plurality of actuators in the at least one of the series being alterable from a first position allowing passage of plugs below a selected size to a second position allowing actuation by plugs of selected sizes, the plurality of actuators within the at least one of the series being distributed within the tubular such that the more upstream of any two of the plurality of actuators is actuatingly engagable with a larger one of the plugs than the more downstream of the two of the plurality of actuators when in the second position, and the plurality of series being distributed such that for any two of the series the more upstream of the two series requires a larger plug to alter the actuators therewithin.

2. The tubular actuating system of claim 1, wherein each of the plurality of actuators includes a repositionable seat that is nonseatable when in the first position and seatable when in the second position.

3. The tubular actuating system of claim 2, wherein the repositionable seat is on a flapper.

4. The tubular actuating system of claim 2, wherein a sleeve maintains the repositionable seat in the nonseatable position when in the first position.

5. The tubular actuating system of claim 1, wherein at least one of the plurality of actuators is actuatable by a plug having dimensions smaller than dimensions of a plug needed to alter the at least one of the plurality of actuators from the first position to the second position.

6. The tubular actuating system of claim 1, wherein the plurality of actuators are actuatable and alterable by plugs that are balls.

7. The tubular actuating system of claim 1, wherein at least one of the plurality of actuators in a series is actuatable by a plug that is at least as large dimensionally as a plug needed to alter the at least one of the plurality of actuators from the first position to the second position.

8. The tubular actuating system of claim 1, wherein all of the plurality of actuators within one of the series are alterable by a plug of a single size.

9. The tubular actuating system of claim 1, wherein at least one of the plurality of actuators opens at least one port to allow fracturing of a formation.

10. A method of actuating a plurality of tubular actuators, comprising:

running at least one plug through a tubular and past a plurality of series of actuators without altering actuators in at least one first of the series;

running an additional plug and altering the actuators in the at least one first of the series;

running additional plugs with sequentially increasing dimensions and actuatingly engaging the actuators in the at least one first of the series;

actuating the actuators in the at least one first of the series;

running an additional plug and altering the actuators in at least on second of the series; and running additional plugs with sequentially increasing dimensions and actuatingly engaging the actuators in the at least one second of the series.

11. The method of actuating a plurality of tubular actuators of claim 10, further comprising actuating the actuators in the at least one second series.

12. The method of actuating a plurality of tubular actuators of claim 10, further comprising actuatingly engaging the actuators in at least one of the at least one first series and the at least one second series in sequential order from the most downstream actuator first to the most upstream actuator.

13. The method of actuating a plurality of tubular actuators of claim 10, further comprising running smaller plugs to actuate actuators within the series than the plug run to alter the actuators within the series.

14. The method of actuating a plurality of tubular actuators of claim 10, further comprising altering the actuators in the at least one first series with a smaller plug than altering the actuators in the at least one second series.

* * * * *